United States Patent [19]

Newsom

[11] Patent Number: 5,058,357

[45] Date of Patent: Oct. 22, 1991

[54] CONSTRUCTION BLOCKS

[75] Inventor: Bob G. Newsom, Etty, Ky.

[73] Assignee: Advanced Building Technologies, Olive Hill, Ky.

[21] Appl. No.: 484,401

[22] Filed: Feb. 26, 1990

Related U.S. Application Data

[63] Continuation-in-part of Ser. No. 246,261, Sep. 20, 1988, Pat. No. 4,903,453.

[51] Int. Cl.[5] ..... E04H 12/00

[52] U.S. Cl. ..... 52/648; 52/378; 52/601

[58] Field of Search ..... 52/648, 79.1, 378, 379, 52/579, 600, 601, 650, 652, 415

[56] References Cited

U.S. PATENT DOCUMENTS

| | | | |
|---|---|---|---|
| 1,733,169 | 10/1929 | Purdy | 52/648 |
| 1,889,547 | 11/1932 | Green | 52/415 |
| 2,049,907 | 8/1936 | Hess . | |
| 2,157,688 | 5/1939 | Cascio | 52/378 |
| 2,933,166 | 4/1960 | Castaine | 52/582 |
| 3,720,022 | 3/1973 | Dattner | 52/79 |
| 3,744,194 | 7/1973 | Ramberg | 52/378 |
| 4,227,357 | 10/1980 | Newsom | 52/344 |
| 4,516,375 | 5/1985 | Pagano et al. | 52/650 |
| 4,782,637 | 11/1988 | Erikkson et al. | 52/648 |
| 4,825,620 | 5/1989 | Johnson | 52/648 X |
| 4,903,453 | 2/1990 | Newsom | 52/379 X |

FOREIGN PATENT DOCUMENTS

| | | | |
|---|---|---|---|
| 530372 | 8/1955 | Italy | 52/79.1 |

*Primary Examiner*—David A. Scherbel
*Assistant Examiner*—Creighton Smith
*Attorney, Agent, or Firm*—Harold Gell

[57] ABSTRACT

A plurality of walls are interconnected to form a hollow construction block including top and bottom contiguous block joining structure. The top contiguous block joining structure includes a first closed geometric shape adjacent to a second closed geometric shape. The first and second geometric shapes protrude above the side walls and have a width less than the width of the overall block and a combined length less than the length of the block. The bottom contiguous block joining structure includes a recess dimensioned to receive a joining structure dimensioned identically to the top contiguous block joining structure.

48 Claims, 14 Drawing Sheets

CONSTRUCTION BLOCKS

RELATED APPLICATIONS

This is a continuation-in-part of copending U.S. Pat. Application Ser. No. 07/246,261 filed Sep. 20, 1988 by Bob G. Newsom and issued Feb. 27, 1990 as U.S. Pat. No. 4,903,453 for "Construction Blocks".

THE INVENTION

This invention relates to a method for building a utilitarian or toy structure which is comprised of assembling a plurality of interlocking building blocks and the building block system incorporated in the method.

BACKGROUND OF THE INVENTION

Historically, man has created structures from masonry blocks. This form of building traces its ancestry from the earliest structures which were piles of rock to contemporary cut stone systems and from sun baked brick to the contemporary trend of utilizing kiln fired bricks and cast cement blocks.

Structures utilizing masonry techniques has become increasingly costly due to the labor and energy involved in transporting the materials to the place of construction and erecting the structure. Masonry items such as brick, cut stone or concrete block are extremely heavy and a significant amount of energy is expended transporting them from their place of origin to the building site. Furthermore, skilled masons are required to lay up the building blocks, whether they be brick, stone or cement and mortar is required to secure the blocks together. Thus the cost of a masonry structure is a function of considerable energy expended in transporting the materials and a significant amount of skilled labor in handling the mortar and blocks.

A second contemporary means of constructions consists of fabricating a structure from a framework of sawn boards and covering the framework with siding and plaster board type materials. This latter method of construction is not as sturdy as the block construction and like the block system, does not provide adequate thermal insulation. Furthermore, the wooden structure is prone to fire and insect damage and it requires constant maintenance to prevent deterioration.

The obvious shortcomings of the foregoing building methods left to the improved construction method disclosed in U.S. Pat. No. 4,227,357 on "Construction Blocks" issued to Bobby G. Newsom on Oct. 14, 1980. In this system, skeletal blocks forced from heavy gauge rod or bar stock are provided with straight and hook projections that permit the blocks to be interconnected to form a structure which will receive furrinq strips or stringers. This concept provides a significant advancement to construction methods but fails to provide adequate strength for certain load bearing wall applications. Furthermore, the rods or bars forming the building blocks do not provide a means whereby wall board or other covering materials may be fastened to the structure. In the construction blocks of U.S. Pat. No. 4,227,357, furring strips are necessary to provide a surface for nailing or adhesively affixing materials to the structural wall.

OBJECTIVES OF THE INVENTION

In view of the obvious shortcomings of the various contemporary building methods, it is an objective of this invention to provide a building block which may be assembled by an unskilled laborer without the aid of mortar to create structures having plumb walls and square corners and insulative and structural integrity that is greater than masonry techniques but requires less man power to assemble than a woodframe structure.

A further objective of the present invention is to provide a method for fabricating a structure which includes assembling a number of blocks comprised of preformed skeletal subassemblies including end frames forming male and female coupling means on opposite ends of each subassembly.

A further objective of the present invention is to provide a method for fabricating a structure which includes assembling a number of blocks comprised of preformed hollow subassemblies including end frames forming male and female coupling means on opposite ends of each subassembly.

A still further objective of the present invention is to provide a building structure comprised of a plurality of interlocking blocks fabricated from formed metal strips.

A still further objective of the present invention is to provide a building structure comprised of a plurality of interlocking blocks fabricated from formed metal strips arranged to create hollow subassemblies joined in pairs to form construction block modules.

A still further objective of the present invention is to provide a building structure comprised of a plurality of interlocking blocks fabricated from cast or molded plastic material shaped to create hollow subassemblies joined to form construction blocks.

It is a further objective of the present invention to provide a building module fabricated from skeletal subassemblies that are shaped in the form of a block and incorporate end frames that will interlock the modules to permit fabricating a structure to meet the needs of the user.

Another objective of the present invention is to provide a method for building a structure comprised of assembling formed skeletal modules, inserting nailing strips in recesses provided therein, securing external and internal facing materials to the modules by nailing the facing materials to the nailing strips and filling the void between the internal and external facing panels with an insulating material.

Another objective of the present invention is to provide a method for building a structure comprised of assembling formed hollow modules, inserting nailing strips in recesses provided therein, securing external and internal facing materials to the modules by nailing the facing materials to the nailing strips and filling the void between the internal and external facing panels with an insulating material.

A still further objective of the present invention is to provide a method for building a structure comprised of assembling formed skeletal modules, inserting nailing strips in recesses provided therein, securing facing materials to one side of the modules by nailing the facing materials to the nailing strips and spraying a masonry or resinous insulating and weatherproofing material over the exposed side of the skeletal modules and back of the facing materials to complete a wall structure.

A still further objective of the present invention is to provide a method for building a structure comprised of assembling formed hollow modules, inserting nailing strips in recesses provided therein, securing facing materials to one side of the modules by nailing the facing materials to the nailing strips and spraying a masonry or resinous insulating and weatherproofing material over the exposed side of the hollow modules and back of the facing materials to complete a wall structure.

Another objective of the present invention is to provide a method for building a structure comprised of assembling formed skeletal modules and securing facing materials to the modules by an adhesive means applied to selected flat surfaces of the formed metal strips creating the modules.

Another objective of the present invention is to provide a method for building a structure comprised of assembling formed hollow modules and securing facing materials to the modules by an adhesive means applied to selected flat surfaces of the formed metal strips creating the modules.

Another objective of the present invention is to provide a method for building a structure comprised of assembling formed skeletal modules and securing facing materials to the modules by dry wall screws applied to selected flat surfaces of the formed metal strips creating the modules.

Another objective of the present invention is to provide a method for building a structure comprised of assembling formed hollow modules and securing facing materials to the modules by dry wall screws applied to selected flat surfaces of the formed metal strips creating the modules.

A still further objective of the present invention is to provide a building structure comprised of formed skeletal modules with facing materials secured by adhesive means to opposite sides of the modules and filling the void between facing panels with an insulating material.

A still further objective of the present invention is to provide a building structure comprised of formed hollow modules with facing materials secured by adhesive means to opposite sides of the modules and filling the void between facing panels with an insulating material.

Another objective is to create building blocks of the class described by the preceding objective which are formed by a molding process and have a sufficient wall thickness to provide a degree of thermal insulation.

Another objective is to create structural elements of the class described by the preceding objectives which may be used as child toys.

Another objective is to create structural elements of the class described by the preceding objectives which may be used as designers prototype modeling aids.

The foregoing and other objectives of the invention will become apparent in light of the drawings, specification and claims contained herein.

SUMMARY OF THE INVENTION

Presented hereby is a building block or module which is fabricated by forming galvanized metal strips, plastic, fiberglass, or any other suitable materials to create a new form of building block structure having dimensions approximately equivalent to contemporary building blocks. Alternately, the building blocks or modules may be created by a molding process. Whether fabricated of strips or molded, they may be scaled down dimensionally to create toys or designers modeling elements. The building blocks include single subassemblies and composites of at least two subassemblies joined by interconnecting webs and may be skeletal or hollow. The geometric shape may be any shape, as a square, rectangle, circle, triangle, hexagon, etc.

In the embodiments using skeletal construction, each skeletal subassembly includes upper and lower frames joined together by a plurality of structural columns perpendicular to the planes of the upper and lower frames. The upper and lower frames are dimensioned to form interfitting male and female receptacles that permit the blocks to be interconnected. D-lance snap fit structures are provided in the upper and lower frames so that an assembly of blocks with structural integrity may be created by snapping together courses of blocks with each course staggered relative to the adjacent course. Recesses are formed in at least one side of each block between subassemblies. The recesses are along the midline and dimensioned to receive nailing strips to which a facing panel may be secured. The skeletal blocks are provided with D-lance snap fit means which lock the male frame ends into the female frame ends of adjacent blocks so that a structure may be fabricated by stacking the blocks in a conventional staggered manner similar to that used in masonry construction.

In the embodiments using hollow or molded construction, the upper and lower frames and perpendicular columns are merged into a tube that may include sealing top and bottom panels. Irrespective of whether or not top and bottom panels are used, snap fit lock means may be incorporated in the top and bottom end of the tubes in a manner similar to that described for the skeletal embodiments or by the creation of convex and concave interfitting ridges or a slot and ball combination.

A structural wall formed from a plurality of the blocks may be considered complete or it may be embellished by inserting nailing strips in recesses and nailing a facing material along one or both sides of the block wall. Alternatively, facing material may be secured directly to the flat surfaces of the strips or blocks. Insulating material may be inserted in the hollow spaces between the facing materials or if desired, facing material may be applied to only one side of the wall and the other completed by spraying a masonry product or other suitable material over the exposed skeletal structure or in the tubes and the back of the facing material to build up a thickness equivalent to the width of the blocks.

DESCRIPTION OF THE INVENTION

Figure 1:
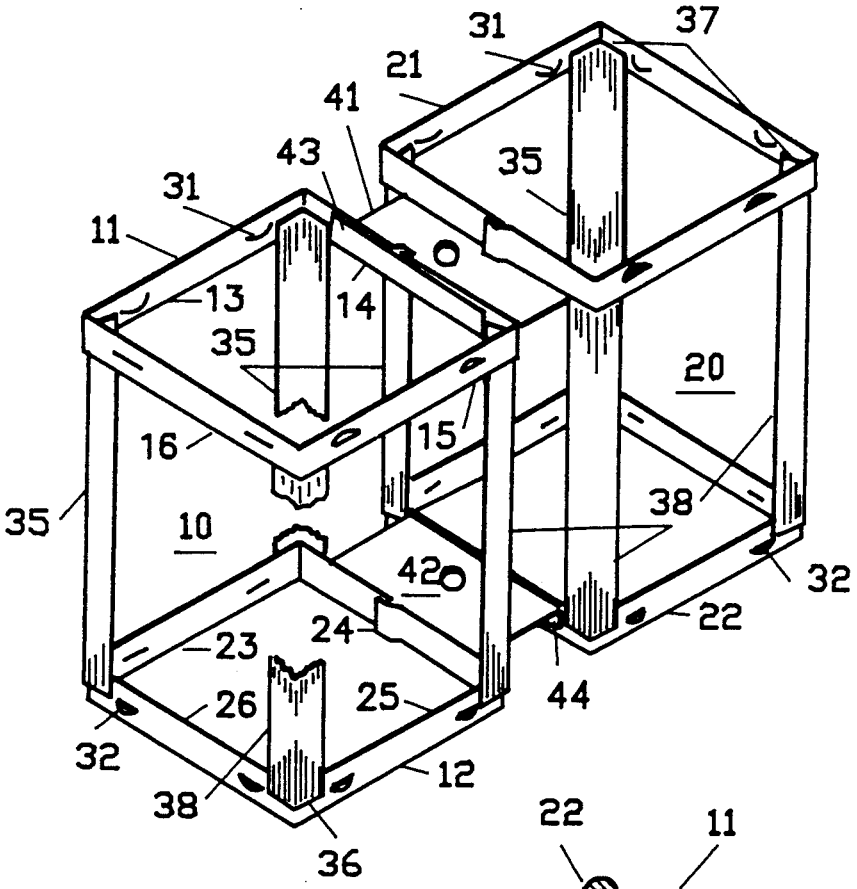
FIG. 1 is a ¾ view of a preferred embodiment of the building block of the present invention.

FIG. 1 illustrates the basic, skeletal building block embodiment upon which this invention is predicated and which is incorporated in the various methods of structure fabrication taught herein. The block is comprised of a framework fabricated from metal, plastic, reinforced plastic or any other material capable of being formed into the required basic strip shapes. In the preferred embodiment, 28 gauge galvanized steel sheet material is used. Preferably, the steel sheet is galvanized after the strips are cut, formed and assembled into skeletal blocks. Regardless of material used, its strength is calculated to meet the anticipated stress which will be encountered in the structure fabricated from a plurality of similar blocks. The use of galvanized metal strips of the preferred embodiment is presented as a convenient form in which to describe the invention. The strips can be fabricated from metal, plastic, fiberglass, boron filament, or a wide variety of materials having the required physical properties which will enable the creation of a strong and resilient structure.

The exemplary building block illustrated in FIG. 1 is comprised of two identical subassemblies identified as 10 and 20. Each subassembly is comprised of a top frame, 11 or 21 respectively. The top frames of the subassemblies are identical. They each form a square in the preferred embodiment but may be any geometric shape limited only by the requirement of having straight sides which match the sides of adjoining structures. They include latch means 31 formed in or affixed to the straps or wall members 13, 14, 15 and 16 forming the top frame structure. A spacer 41 connects top frames 11 and 21 together. In the illustrated embodiment, the spacer is fabricated from the same material as the top frames, that is, 28 gauge steel sheet material which is galvanized after the manufacturing assembly of the block.

Each subassembly includes a bottom frame, 12 or 22. The bottom frames are identical to the top frames except they are formed slightly smaller than the top frame so that a bottom frame will nest within a top frame in the manner of a male and female coupling. The bottom frames are provided with snap fit coupling elements 32 which cooperate with the snap fit coupling elements 31 when two blocks are nested together. The bottom frames comprised of side walls 23, 24, 25 and 26 are joined by a spacer 42 which, in the illustrated embodiment, is identical to spacer 41. In FIG. 1, spacer 41 includes flanges, 43, on either side which are secured to the inside of the top frame straps.

The spacer 42 joining the bottom frames is secured by flanges 44 to the outside of the lower frame straps to accommodate the differences in dimensions between the top and bottom frames. The top and bottom frames are joined by angle members 35 and 38 positioned at each corner to complete the basic block structure comprised of two similarly shaped subassemblies having top and bottom frames dimensioned so that blocks can be interconnected by the male and female joint functions created by their relative dimensional differences. The corner legs 35 and 38 are secured to the inside of the corners of the top frame and to the outside of the corners in the bottom frame to accommodate the differences in dimension between the top and bottom frames. When the frames are assembled, the bottom, 36 of each leg 35 or 38 rests on the top, 37 of the mated block structure so that a column of subassemblies, 10 and 10, result in a building structure comprised of four columns of angle members securely held relative to each other by top and bottom frames to effect a continuous vertical, load bearing structure.

Figure 11:
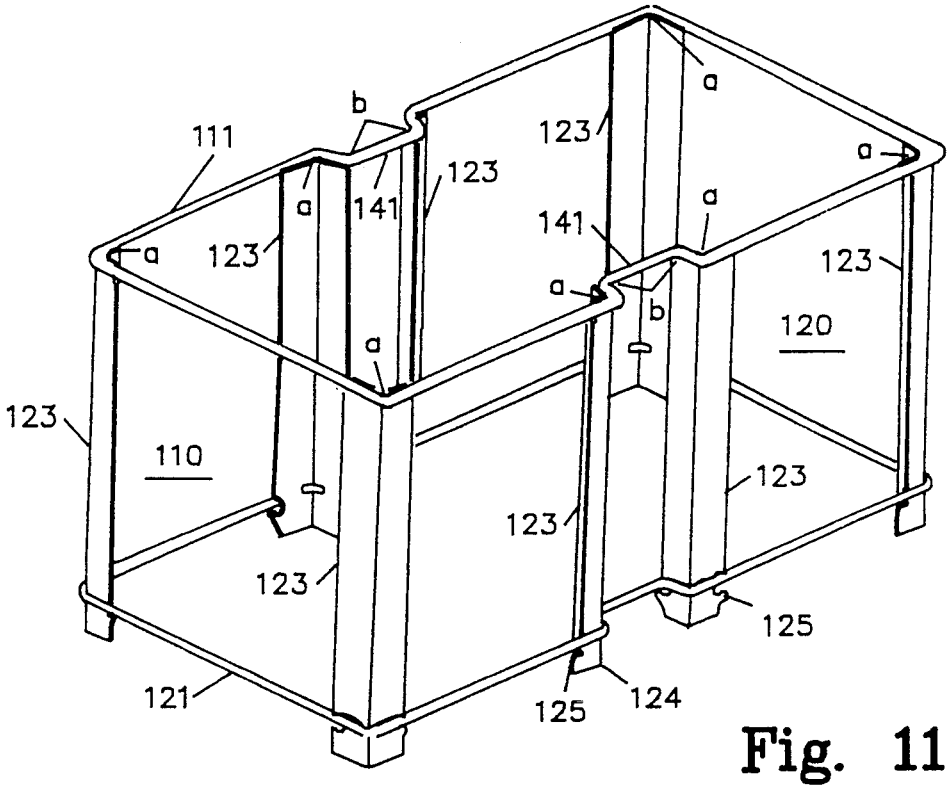
FIG. 11 is an alternate embodiment fabricated from bent rod and angle sections.

The exemplary building blocks illustrated in FIG. 1 may be fabricated as illustrated in FIG. 11. In this embodiment, the block is comprised of two identical halves identified as 110 and 120. Each half is comprised of a portion of top frame 111. The top frame portion of the halves are identical. They each form a square in the preferred embodiment but may be any geometric shape. A spacer 141 connects the two portions of the top frame 110 together. In the illustrated embodiment, the top frame is fabricated from a bent rod or ridged wire formed into a continuum creating the shape of each half, 110 and 120, and the joining spacers 141.

Each block includes a bottom frame, 112 which is identical to the top frame except it is formed slightly smaller than the top frame so that a bottom frame will nest within a top frame in the manner of a male and female coupling. Alternatively, the top and bottom frames may be identical in all respects with the dimension differences required to nest two blocks together provided by a slight offset formed in the bottom ends of the angle members 123.

The various benefits of the building block illustrated in FIG. 1 may be obtained from the alternate embodiment of FIG. 11. In this adaptation, first and second identical wire frames, 111 and 121, form closed geometric shapes comprised of a geometric shape joined to its mirror image. The closed geometric shapes include a plurality of bends forming angles of two classes. The angles of the first class are positive angles identified by the letter "a" in FIG. 11 and the other angles are negative and identified by the letter "b". The algebraic sum of all the angles comprising a frame equals 360 degrees.

A plurality of braces 123 connect the first and second wire frames together in a superposed, spaced apart orientation. The braces are angle beams including an angle equal to an angle of a bend in the geometric shape. They are secured to the inside of the frames, each within a bend having an angle corresponding to the angle of the brace and with the open side of said angle, the hypotenuse side, oriented away from the adjacent section of the frame and toward the interior of the geometric shape.

In FIG. 11, eight identical angle members are secured to the top and bottom frames 111 and 121 to complete a building module.

The lower segment 124 of each leg or angle member is offset inward so that the bottom of one module may be slipped into the top of another. Bent ears 125 are formed at the bottom, 124, vertical edges of each leg. These ears are dimensioned so that when blocks are nested, the top frame 111 of the lower block will deflect the ears as they pass during joining. When the bottom frame 121 is resting on the top frame 110 of a lower block, the ears snap back to their normal position and lock the two blocks together.

Figure 3:
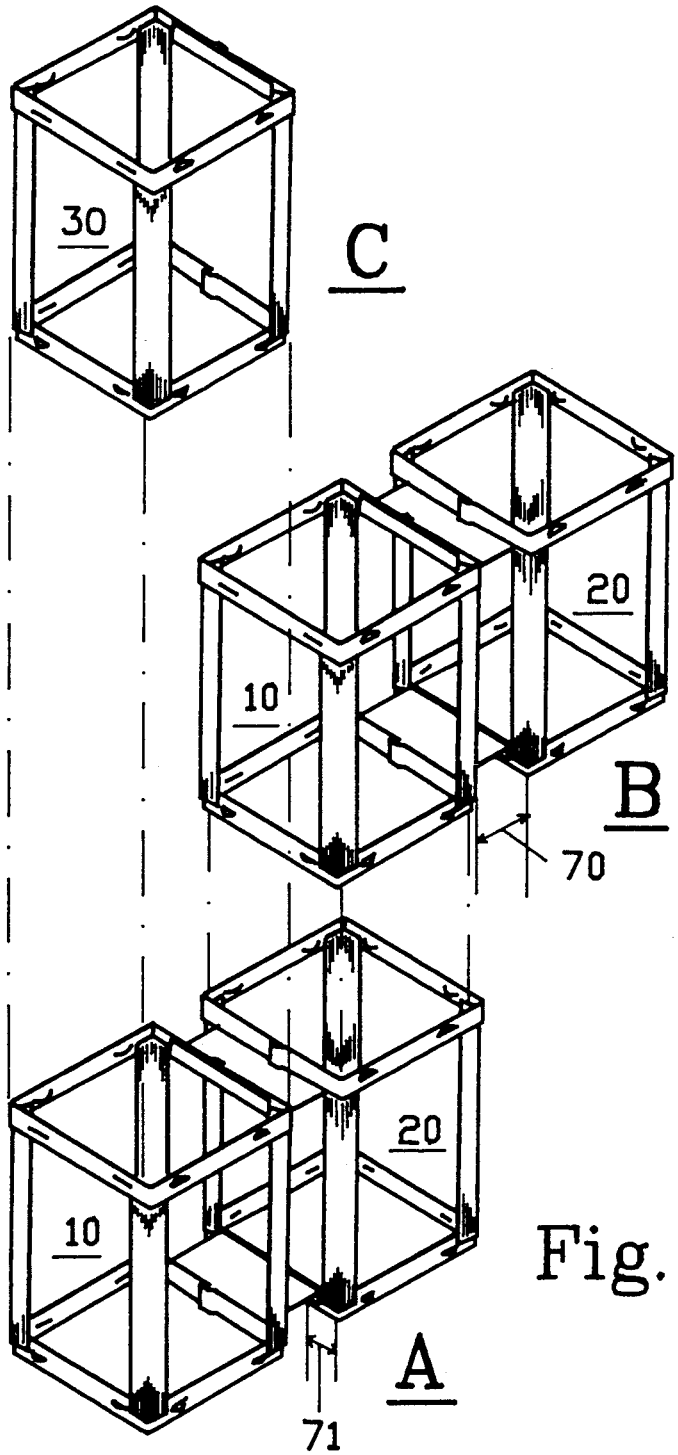
FIG. 3 illustrates the relationship of two block assemblies being brought together to form a straight wall section.

Nesting of two block assemblies to create a straight wall is illustrated in FIG. 3. Subassembly 10 of block "B" is inserted into subassembly 20 of block "A" to create a staggered interlock. A similar staggered interlock may be used with the block embodiment of FIG. 11 or any other configuration disclosed or implied herein.

Single, unattached subassemblies are provided to square off wall ends, such as the single block 30 of FIG. 3. This block locks into the top of subassembly 10 of block A and if an overlying course is required, it will lock into the top of block 30 just as subassembly 10 of block B locks into subassembly 20 of block A.

Figure 2:
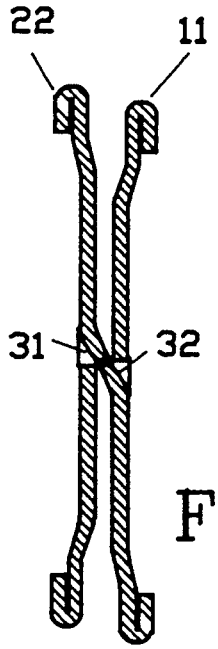
FIG. 2 is a cutaway view of a male and female frame end taken through the D-lance snap-fit structure.

FIG. 2 illustrates a cutaway section of a side strap of a top frame 11 and bottom frame 22 of a pair of nested subassemblies. A D-lance arrangement is illustrated to provide a snap fit for the two frames but other mechanical fasteners such as screws, nuts and bolts, rivets, glue or nails may be used. The D-lance is created by horizontal cuts through the strap material of 11 and 22 of FIGS. 1 and 2 and deformation of the metal adjacent to the slits creates an arcuate extension 31 or 32. In the embodiment illustrated in FIG. 2, the upper frame member, 11, is identical to the lower frame member except in size and the metal is deformed in the opposite side of the cut through the web to create the interlocking shape.

Figure 4:
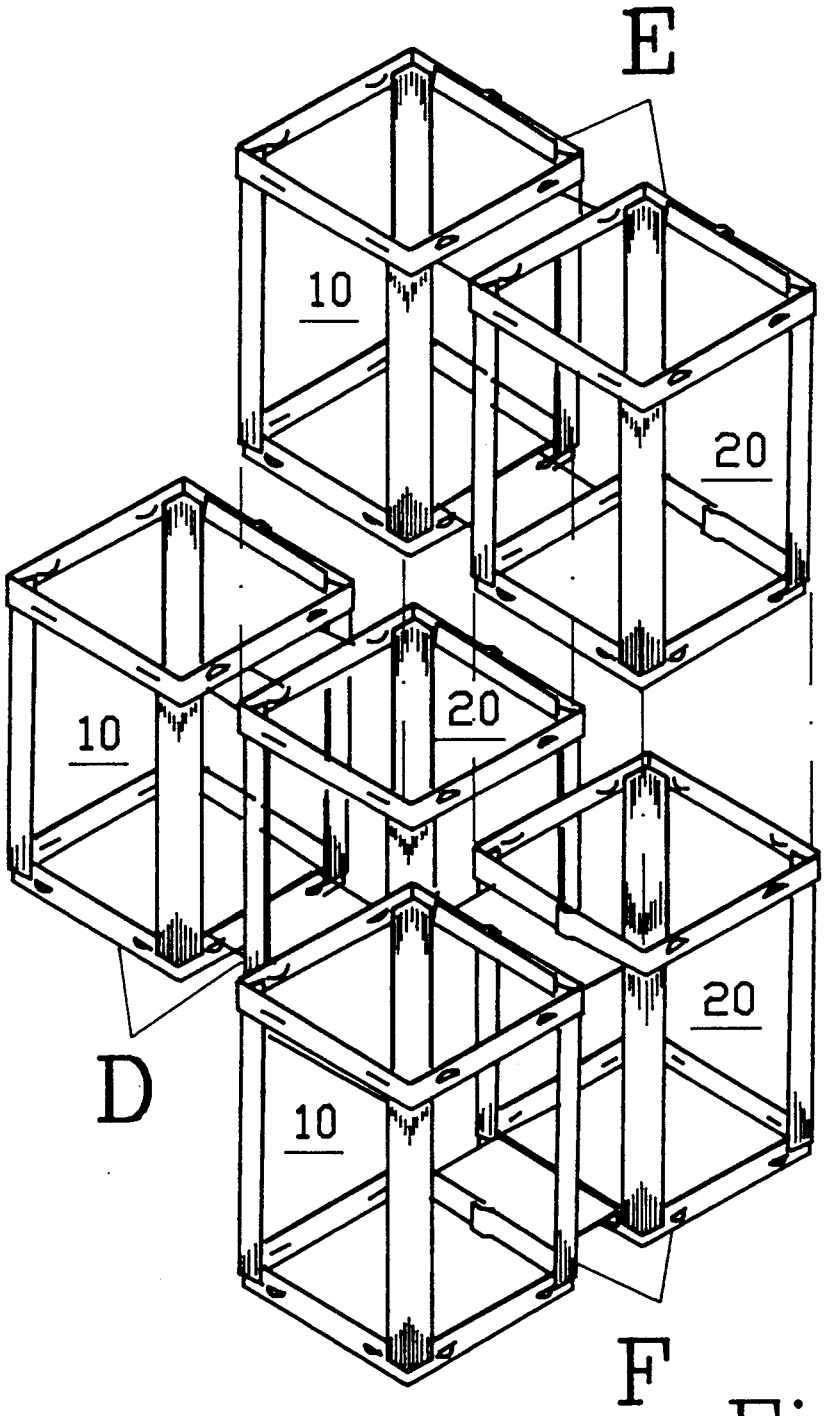
FIG. 4 is an exploded view of two block assemblies arranged to form a 90 degree corner.

FIG. 4 illustrates block assemblies arranged at right angles to form a corner. Blocks "F" and "D" are placed at 90 degrees to each other and interlocked by block "E" which is in the same plane as block "D" and 90 degrees to block "F". Note that subassembly 10 of block "E" fits into subassembly 20 of block "D" and subassembly 20 of block "E" fits into subassembly 20 of block "F".

Figure 5:
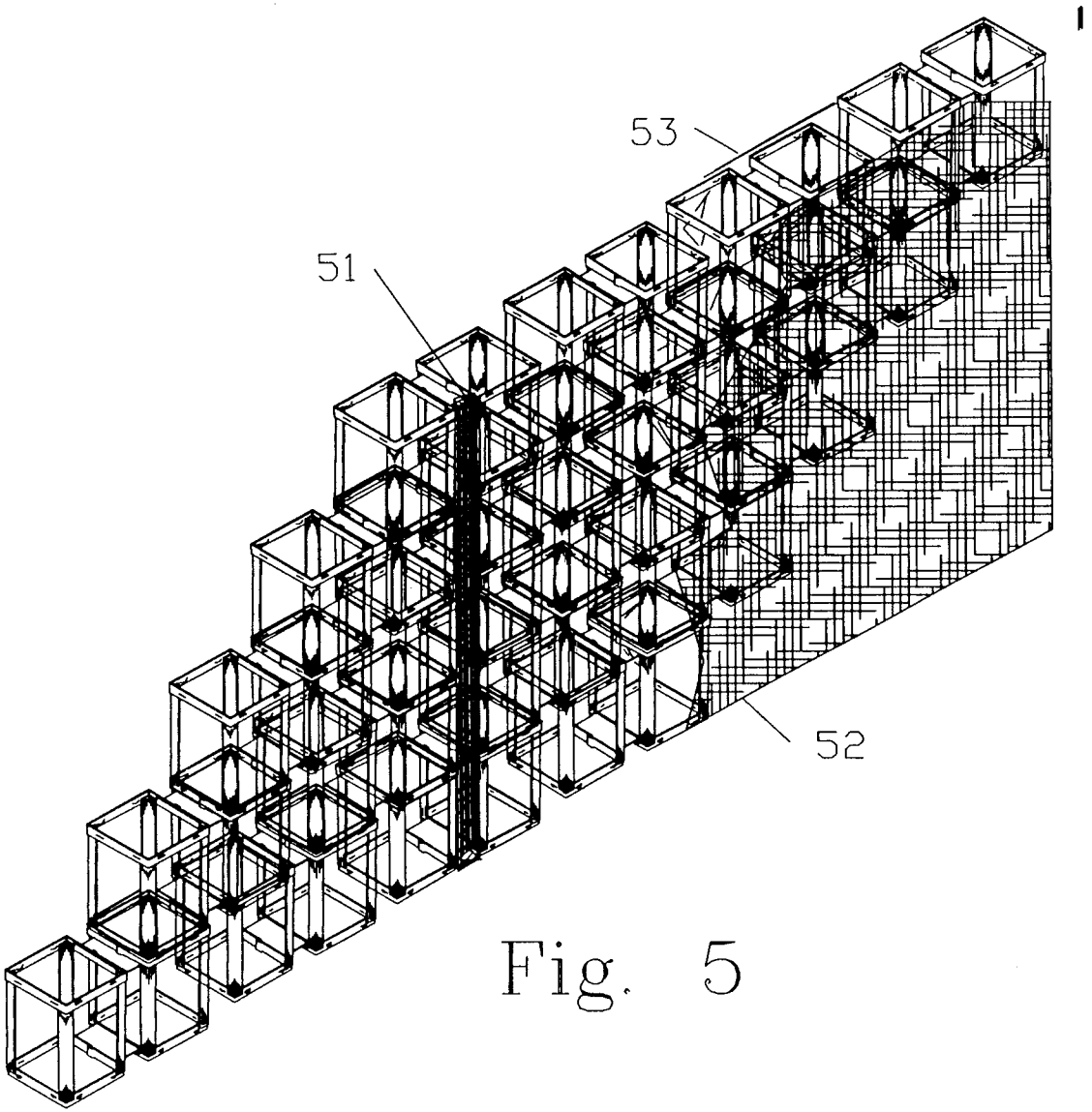
FIG. 5 is a cutaway view illustrating a basic structural wall of the present invention.

When a plurality of blocks are assembled with the top and bottom frames of the subassemblies nested or interconnected together as illustrated in FIGS. 3 or 4, a structural wall having significant load bearing properties is created. In a preferred embodiment, FIG. 5, the blocks are set so that the top frame receives the bottom frame of the next course of blocks in a staggered interlock arrangement as illustrated in FIG. 3. This results in a structure having vertical channels dimensioned as a function of spacing web members 41 and 42 which may be used to support floor joists or roof truss members. Studs, such as wood 1×2's or metal studs are set into the channels. In the fabrication of the basic blocks, the spacers are dimensioned so that the end product will match the type of stringer or stud that is to be used in the wall assembly. That is, the length of the spacer creates a space, 70, between vertical members of adjacent subassemblies 10 and which equals the width of the studs to be used, see FIG. 3. The length of the spacer is controlled so the distance between its edges and block face, 71, equals the depth of the stud. FIG. 5 illustrates the use of metal studs 51 positioned in the channels formed by the web spacing between subassemblies of alternate courses and the spacing between blocks in the adjacent courses.

FIG. 5 is a cutaway view of a wall assembled from a plurality of blocks to illustrate the use of a metal or wood studs 51 which provide a nailing surface for wall sheathing 52 and 53 as well as structural integrity for the assembled wall. If desired, the wall sheathing may be secured directly to the blocks by adhesives or any of a number of mechanical fasteners such as nuts and bolts, rivets, screws, dry wall screws, spring clips etc.

When mechanical fastened devices such as screws are used to hold a wall sheathing to the basic skeletal structure, the snap fittings 31 and 32 may be eliminated in favor of securing the blocks together by the same mechanical device which secures the wall sheathing to the structure. If additional security is required, additional mechanical fasteners such as nuts and bolts, rivets, screws or clamps may be used in addition to those securing the sheathing to the structure.

The space between wall sheathing 52 and 53 of FIG. 5 may be filled with an insulating material or concrete. One or both sheathings may be removed after the filling material 55 sets, see FIG. 6. Alternately, only one side of the wall may be covered by sheathing and the filling material may be packed into the skeletal framework by any standard means such as hand packing or pneumatic blowing.

The bottom course of blocks in a wall may be set in a footer excavation or concrete form such that when the footer material, such as concrete, is poured, it will be reinforced by the blocks. In this type of structure, the top of the block course must extend above the concrete high enough to receive the bottoms of the next course of blocks as illustrated in FIG. 6 where the bottom courses 63 and 64 are set in footers 61 and 62.

The block structure illustrated in FIGS. 1 and 3 through 5 is fabricated using vertical support members 35 and 38 of equal dimensions. If required, the vertical members 35 may be different in length than vertical members 38. This results in a structure which may be used to create an arch. FIG. 6 illustrates such a structure where support members 35 are shorter than support members 38. A more esthetic and stronger structure may be created by curving support members 35 and 38 to conform with the overall dimensions of the desired arch 60.

Figure 6:
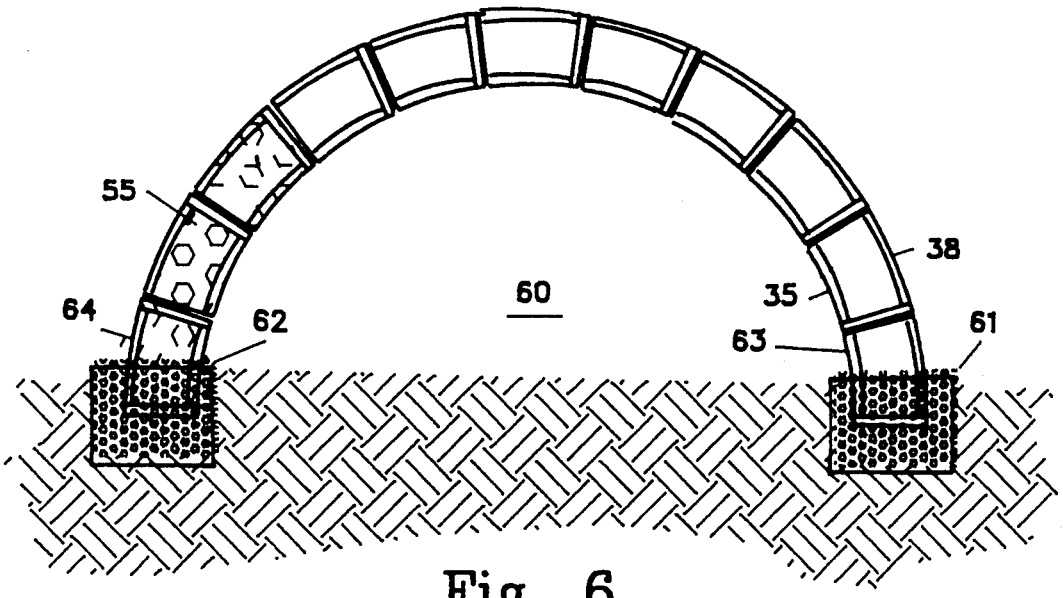
FIG. 6 is a cutaway view illustrating an arch fabricated from the structural blocks of the present invention.

In FIG. 6, the arch 60 is secured at both ends to footers 61 and 62 which, may be partially buried in the earth as required by local building codes.

Figure 7:
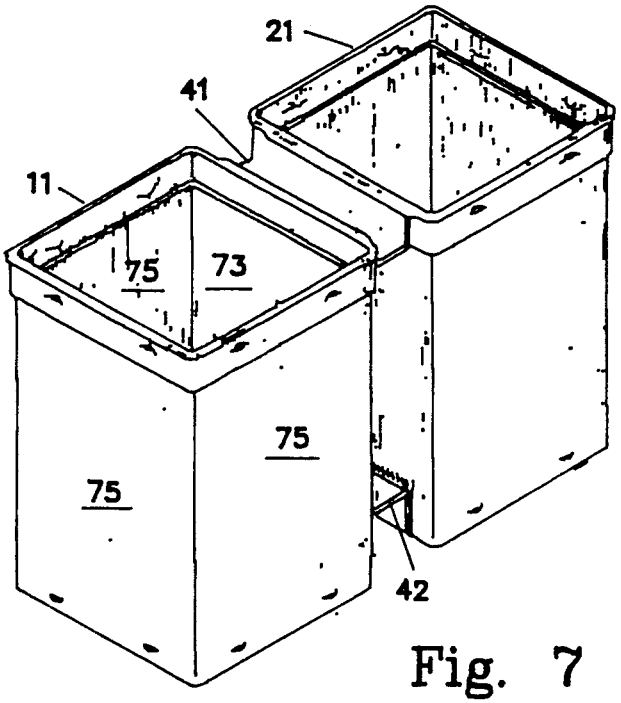
FIG. 7 is a ¾ view of an alternate embodiment of the building block of the present invention.

An alternate embodiment of the building blocks illustrated in FIGS. 1 through 6 is illustrated in FIG. 7 wherein the side walls which comprise the top and bottom frames of the skeletal embodiment are extended to join and create a tube, thereby eliminating the need for the corner, vertical support channels. In this embodiment, each subassembly tube may be fabricated from a bent metal sheet or cast or molded from a plastic or similar material. In the illustrated embodiment, a top frame 11 similar to the top frame of the skeletal embodiment is joined to the extended side walls 73, 74, 75 and 76 of the bottom frame. This could be reversed with the top frame side walls being extended to join the bottom frame side walls or, in a still further version of the tube embodiments, the top and bottom frames similar to those utilized in FIGS. 1 through 5 may be joined by walls which replaces the vertical channels of FIGS. 1 through 5 to join the top and bottom frames together to create a tubular structure. The subassemblies so created result in blocks with totally enclosed sides having open tops and bottoms to permit inserting reinforcing rods 77 and filling the tubes with concrete 78 to create solid pillars within a wall frame work.

Figure 8:
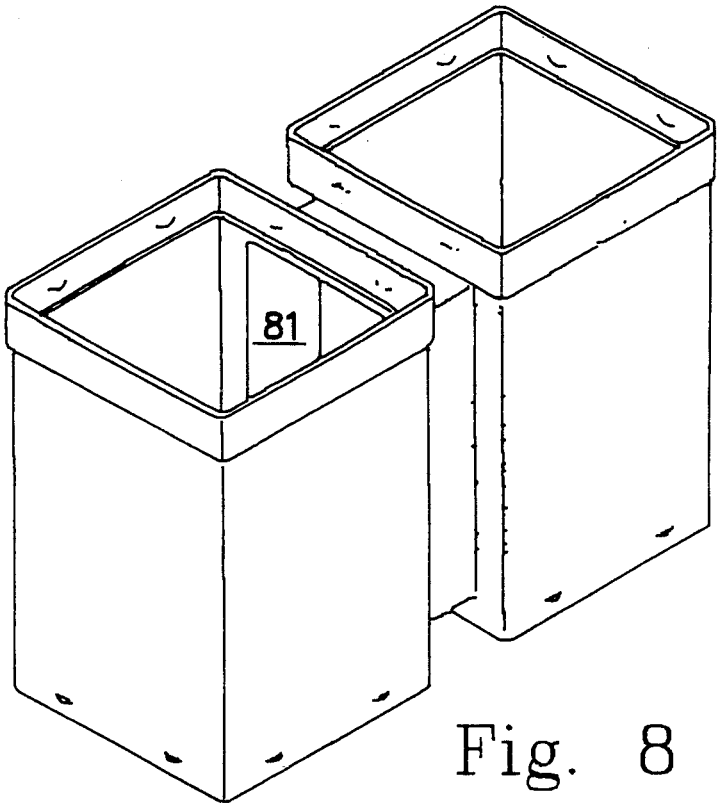
FIG. 8 is a modified form of the alternate embodiment illustrated in FIG. 7.

FIG. 8 illustrates another version of the alternate tubular embodiment illustrated in FIG. 7. In this version, the bottom of the tubular structure is closed to create a pair of containers. In the illustrated version, the joining webs 41 and 42 of FIGS. 1 and 7 are replaced by a conduit 81 which joins the two subassemblies together to create a continuous container that may be used to transport materials to a building site. After materials are removed for use at the site, the container is then used to build a structure. Thus this adaptation of the invention provides an ideal building block for military use or use in remote areas because a building block may be used as a back pack to allow individuals to carry materials to a building site and then the back pack, after it is no longer needed, is used to form part of a structure.

Figure 9:
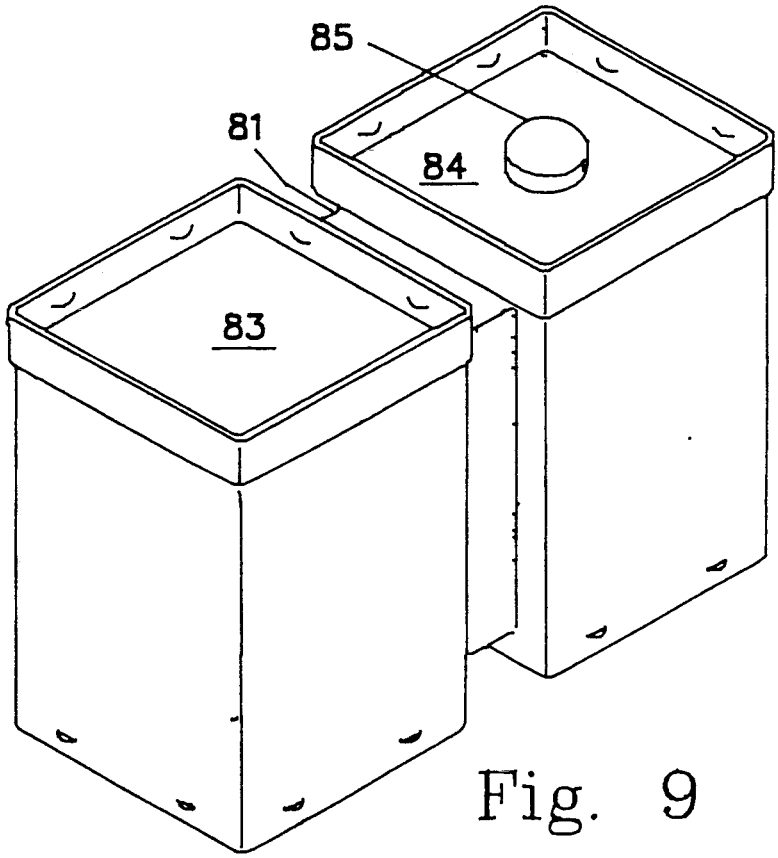
FIG. 9 is a modified form of the alternate embodiment illustrated in FIG. 8.
Figure 10:
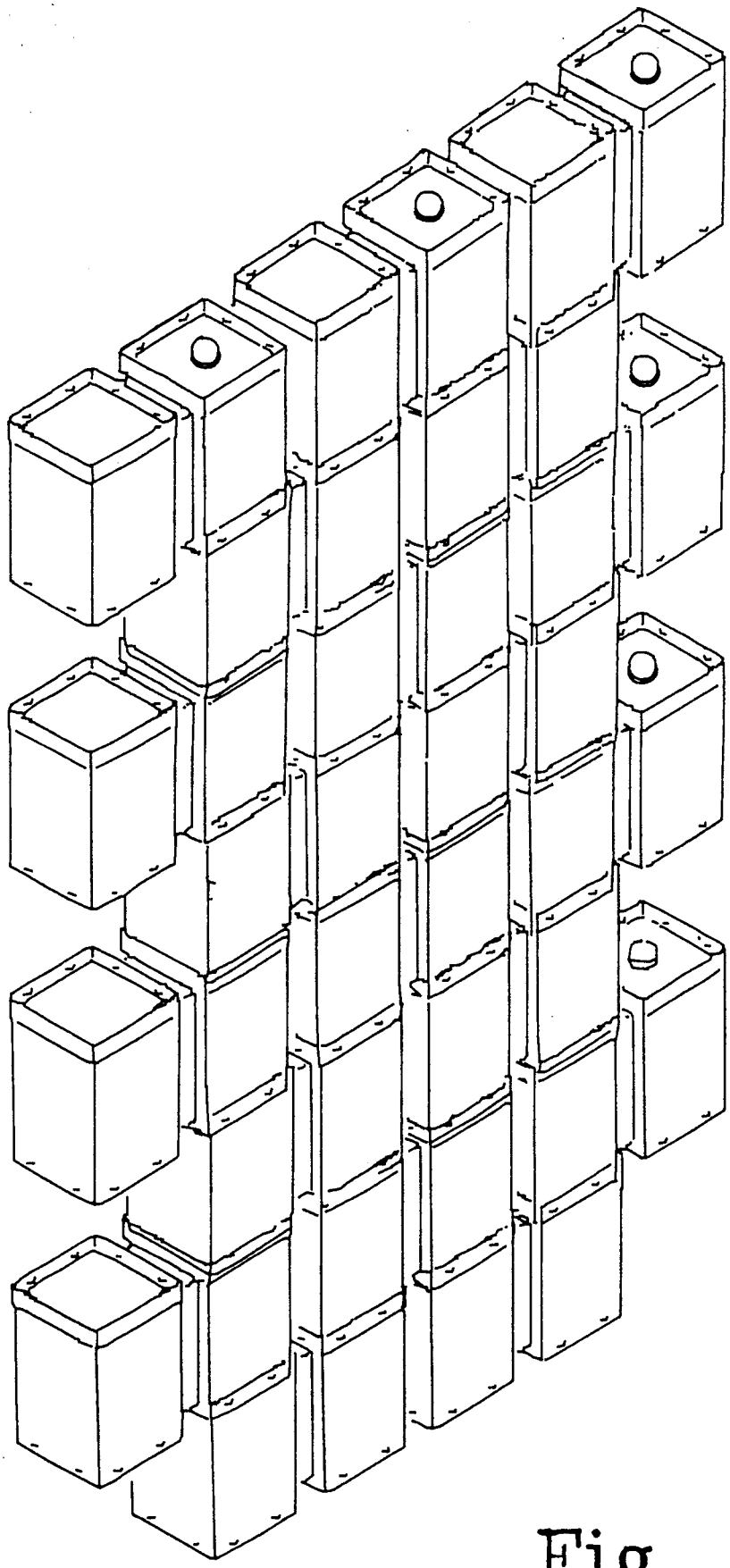
FIG. 10 is a floating platform constructed from a form of the invention illustrated in FIG. 9.

FIG. 9 is a still further variation of the tubular embodiment of FIGS. 7 and 8. In this embodiment, a bottom closes the tubes as in FIG. 8 and top 83 and 84 are sealed within the top frames to create closed containers. A spout and cap 85 may be provided in one or both tops to permit adding and removing materials from the vessel. When this version of the invention is used, a plurality of containers may be joined together to create a raft or similar floating structure. For instance, if a group of closed containers similar to those illustrated in FIG. 9 are assembled as illustrated in FIG. 3, the resultant item may be used as a wall or as a raft or floating dock such as illustrated in FIG. 10.

Figure 12:
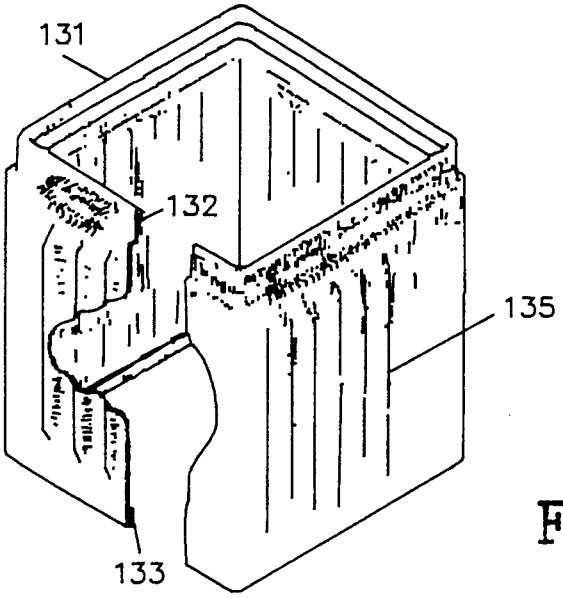
FIG. 12 depicts a tubular subassembly using corrugated sides.
Figure 13:
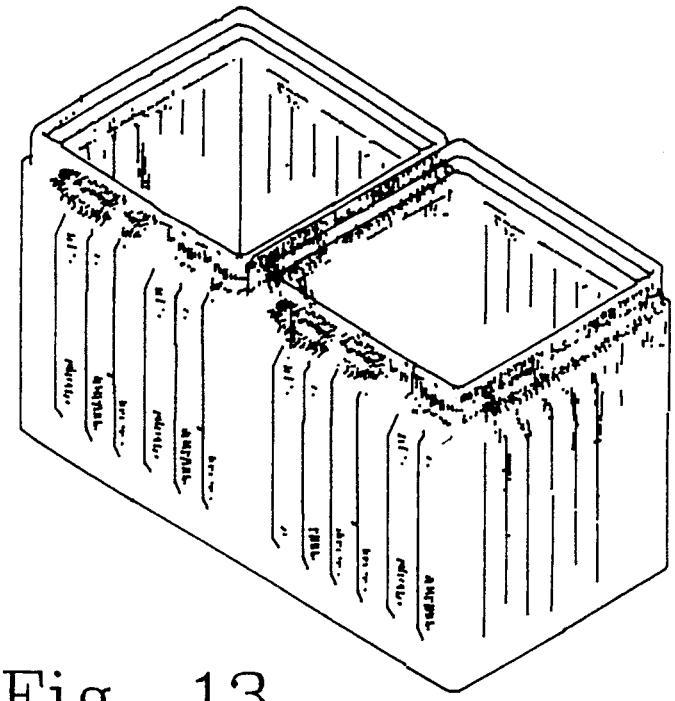
FIG. 13 illustrates a modular building block created by joining two subassemblies of the type illustrated in FIG. 12.

Another version of the tubular embodiment is presented by FIGS. 12 and 13. FIG. 12 illustrates a single subassembly which may be used in a fashion previously described for the use of the embodiment illustrated in FIG. 3. That is, to finish off the edge of a straight wall comprised of a plurality of interlocking blocks.

Figure 14:
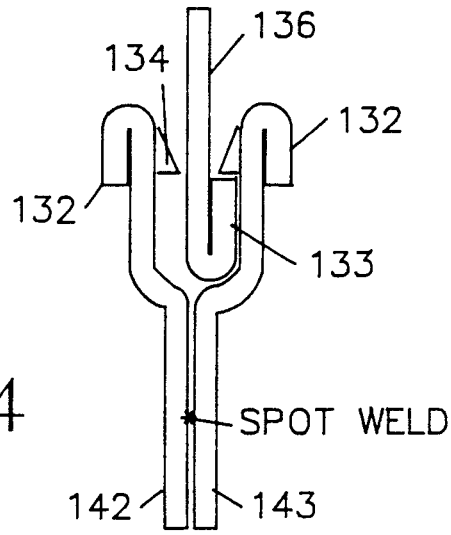
FIG. 14 is a cutaway view of the joint between nested blocks of the type illustrated in FIG. 13.

The subassembly illustrated in FIG. 12 incorporates a top end segment 131 which is reduced in dimension with respect to the remainder of the subassembly so that two subassemblies may be interfit with the bottom of one subassembly fitting over the reduced dimension portion 131 of another subassembly. The edges of the material are rolled in at the top to create a U-shaped cross-section as illustrated in the cutaway portion of FIG. 12 at 132. A similar rolled effect is created at the other end of the material to create another U-shaped cross-section 133 along the bottom edge of the tubular structure. The material is slit at strategic points such as 134 around the perimeter of the reduced dimension top portion of the structure and bent out in an arcuate fashion to create a D-lock configuration. This may be more readily seen in FIG. 14 which was a cross-section of two subassemblies spot welded together to create a building block where the joining spacer is eliminated and two subassemblies are secured directly together through the use of spot welding or similar techniques. In FIG. 14, the lower end of an upper block is indicated as 133 and the upper portion of two subassemblies joined together to form a block assembly are indicated as 142 and 143 respectively. Note that the subassembly 136 of the upper block enters the space between the reduced dimension tops of the subassemblies creating the lower block. The rolled over end 133 of the upper block snaps in behind the bent out portion 134 to lock the upper subassembly to the lower block. A second upper subassembly will fit into the U-shaped recess caused by subassemblies 142 and 143 to lock a second block to the lower block in a nested, interfitting fashion as previously explained and illustrated in FIG. 4.

The vertical corrugations 135 formed in the side walls of the subassemblies provide increased rigidity and a means to orient material to be placed against the subassemblies when they are formed into a wall that is to be overlaying with additional structure.

Relatively strong structures may be created from low density materials using molding techniques to create the further embodiment illustrated in FIGS. 15 through 21. In this embodiment, a low density plastic is molded to create the basic shapes but notwithstanding the fact that a low density plastic is considered to be the preferred embodiment, it is anticipated that significantly stronger structures may be fabricated using this basic embodiment with a variety of moldable materials.

Figure 15:
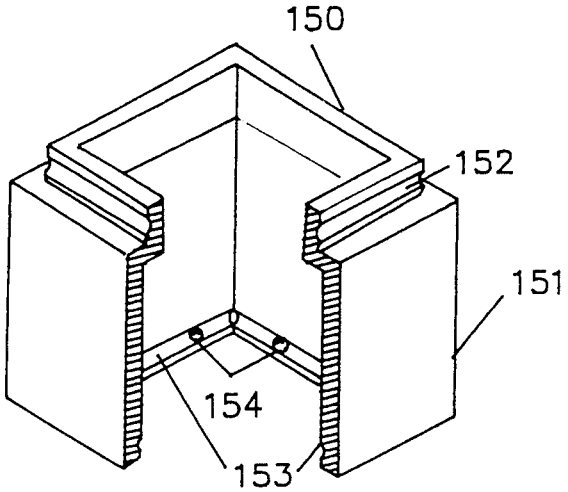
FIG. 15 depicts a basic subassembly or half block of an alternate embodiment using molding techniques.
Figure 19:
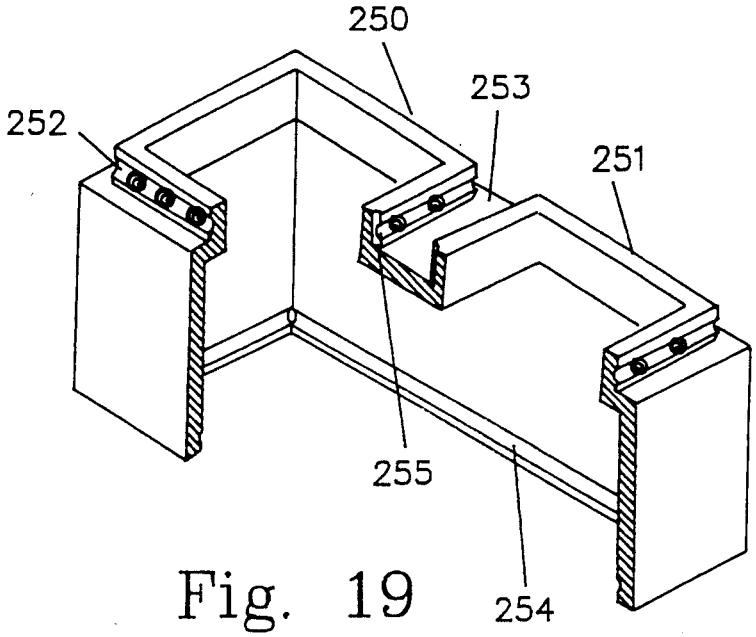
FIG. 19 is a cutaway view of a full block module incorporating two locking top extensions which enable interlocking nesting assembly of a plurality of blocks.

The basic element of this additional embodiment is illustrated in FIG. 15. This figure depicts a single subassembly of the type which is normally joined in pairs to create a building block as illustrated in FIG. 19. To simplify the description of this block, a rectangular assembly fabricated from a pair of square subassemblies similar to that illustrated in FIG. 15 is used. This should not be taken as a limiting concept however because it is contemplated that the block can be fabricated in any geometric shape.

The basic block of this embodiment illustrated in FIG. 15 is constructed of a moldable material. It has a relatively thick cross-section as illustrated by the cutaway portion in the drawing. The top segment 150 is smaller in diameter by the combined thickness of the sides of the lower portion of the subassembly 151 so that one subassembly may be nested over the other. A "U" shaped channel is formed around the outer perimeter of the top inset segment 150 and a second "U" shaped channel 153 is formed around the inside of the lower portion of the block. Channels 152 and 153 are positioned so that when two blocks are nested, channel 152 of the bottom block is aligned with channel 153 of the top block to form a closed channel within and between the overlapping portions of the blocks. One or more balls or spherical elements 154 having a diameter approximately equal to the width of at least one channel are positioned within the channel before the blocks are nested. When nested, the balls snap into the channel of the mating block to lock the two elements together. The preferred cross sectional dimensions of the "U" shaped channels are based on the ball diameter, i.e. the depth of each channel is equal to the radius of the locking balls and the width of the channels equals the diameter of the balls. Ideally, cross section geometry of the channels is hemispherical.

In some situations, the properties of the block may demand a variation of the preferred channel ball dimensions. For instance, in cases where the blocks are not resilient enough to allow flexing about the radius of the size ball desired in the locking couple, one channel may have a width equal to the ball diameter and a depth greater than the ball radius. In this configuration, the mating channel would have a width and depth equal to the portion of the ball protruding over the edge of the deeper channel. In this configuration, the opening at the top of the larger channel may be smaller than the diameter of the balls and flair to the ball diameter at a point above the bottom of the channel equal to the radius of the ball. In this configuration, the balls are snapped into the channel by force or through key ways at strategic points along the channel and held by the channel to simplify assembly and packaging.

Figure 16:
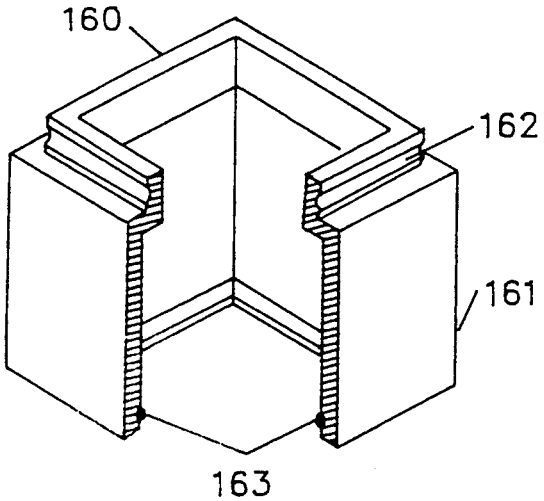
FIG. 16 is an illustration of a version of the embodiment illustrated in FIG. 15 with the roller of the mating elements reversed.

In FIG. 16 channel 162 is similar to channel 152 of FIG. 15 but it is dimensioned to cooperate with a radial protrusion 163 formed around the inside of the lower portion of the subassembly. This radial protrusion is dimensioned and positioned so that it will lock into the groove 162 of a mating subassembly when blocks are nested together.

In FIG. 16 a radial protrusion 162 is provided about the outer perimeter of the reduced dimensioned upper segment 160 of the block while a radial groove 163 is provided inside the lower segment 161 so that a coupling part is formed in the block which will permit two subassemblies to be interlocked in much the same fashion as described for FIG. 15 except that the male coupling parts are protrusions formed on the block stead of balls. FIG. 16 illustrates a designers choice for this variation of the invention but it is contemplated that the locking elements may be reversed. The protrusions may be continuous around the block periphery or they may be segmented as illustrated in FIG. 17.

Figure 17:
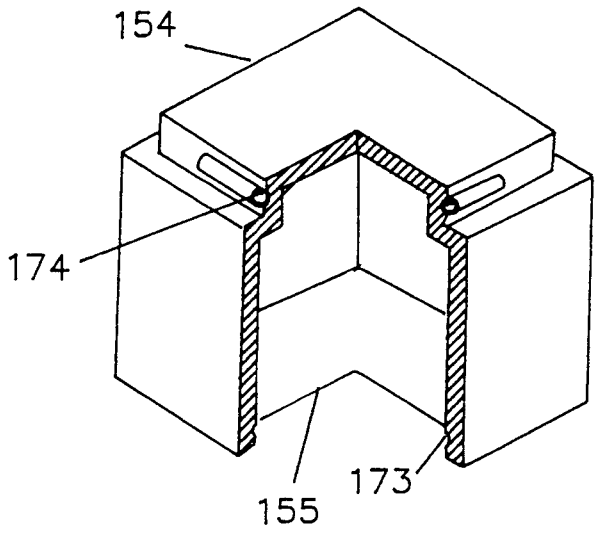
FIG. 17 depicts the embodiment of FIGS. 15 and 16 with a closed top and sealed bottom.

In FIG. 17, small recessed areas 173 replace the continuous channels 152, 153 and 162 of FIGS. 15 and 16. If the locking ball concept of FIG. 15 is to be used, balls 174 are held within channels or small recesses. Alternately, 174 may be a protrusion formed on the face of the block.

It is contemplated that the embodiment using the radial grooves and protrusions will find the most utility when the invention is reduced to practice as a toy or modeling element.

FIG. 17 depicts a further refinement of the embodiment illustrated in FIGS. 15 and 16. In this version, a top portion 154 is included in the molded element to create a more ridged structure.

Figure 18:
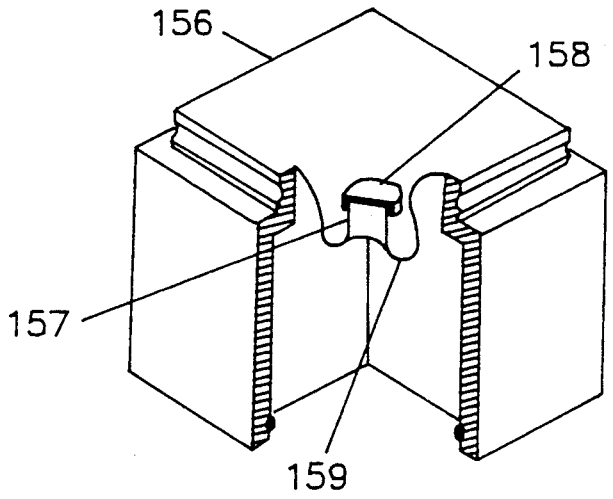
FIG. 18 is an embodiment adapted for use as a container for liquids or flowable solids.

FIG. 18 illustrates a still further adaptation which includes a bottom closure or insert 156. In this embodiment, the closed top 154 may be provided with a neck or pouring spout 157 closed by cap 158. The neck or pouring spout 157 is configured so that it will extend from the block surface or be pushed down into the block as illustrated by the creation of a U-shaped segment 159 which becomes a straight segment when the neck is pulled out.

FIG. 19 is a cutaway view of the preferred version of the molded embodiment which incorporates a pair of interlocking extensions 250 and 251. The extensions are identical to extension 150 or 160 illustrated in the block halves presented in FIGS. 15 through 18. The space provided between the top extensions is equal to twice the thickness of the end material in the lower portion of the block so that two blocks may be joined to the top of a single block in an overlapping, interfitting network similar to that illustrated in FIGS. 4 and 5. In the block illustrated in FIG. 19, a groove 252 is provided only on the longitudinal sides of the top extensions when the material from which the block is molded relatively rigid and would prevent insertion of two side wall ends having male coupling means in the space 253 between the top extensions 250 and 251. In this case, the locking radial extensions or balls on the inner bottom are provided only on the longitudinal inner side walls as illustrated by 254. Vertical relief channels 255 are incorporated as dictated by the rigidity of the block material to permit the deflection required for coupling.

If the blocks are fabricated from a material resilient enough to allow two side walls to be forced into slot 253 with radial locking extensions, the locking grooves and extensions may be provided around the complete perimeter of the exterior top protrusions and interior bottom sections as illustrated in FIGS. 15 through 17.

Figure 20:
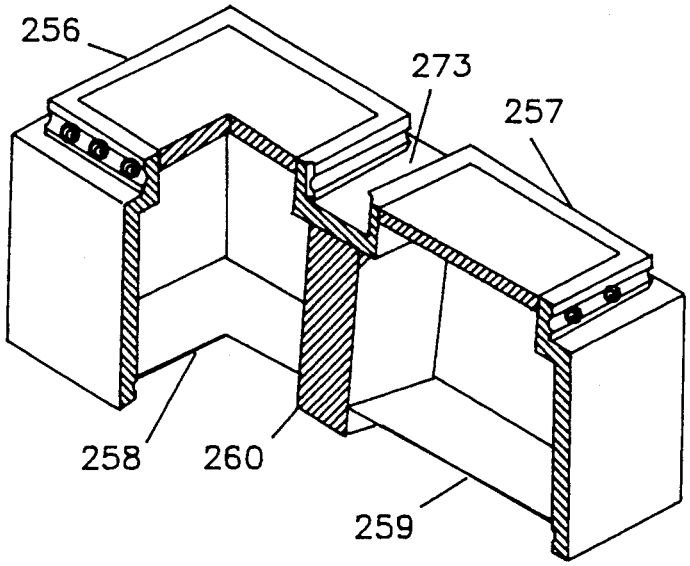
FIG. 20 is a cutaway view of a full block with a center web creating two compartments, each of which is closed at the top and bottom.

FIG. 20 is a cutaway view of a full block including dual top extensions similar to those illustrated in FIG. 19. This block includes a center web 260 to increase the strength of the modular unit and molded top closures 256 and 257 to further increase the system's rigidity. The dual compartments formed by this molded article are closed by panels 258 and 259 which are bonded into the bottom recesses. In the alternate configuration of the molded embodiment illustrated in FIG. 20, the exterior perimeter of the top extensions is smooth as is the nesting recess in the bottoms of the block. This allows for easy assembly with nested blocks held together by the wedging force of the ends of two block halves positioned within the center space 273 of a block. If the construction material is resilient enough to allow flexing of the walls during assembly, the exterior top extensions and interior nesting depressions may be provided with mating radial grooves and extensions similar to those illustrated in FIGS. 15 through 18.

Figure 21:
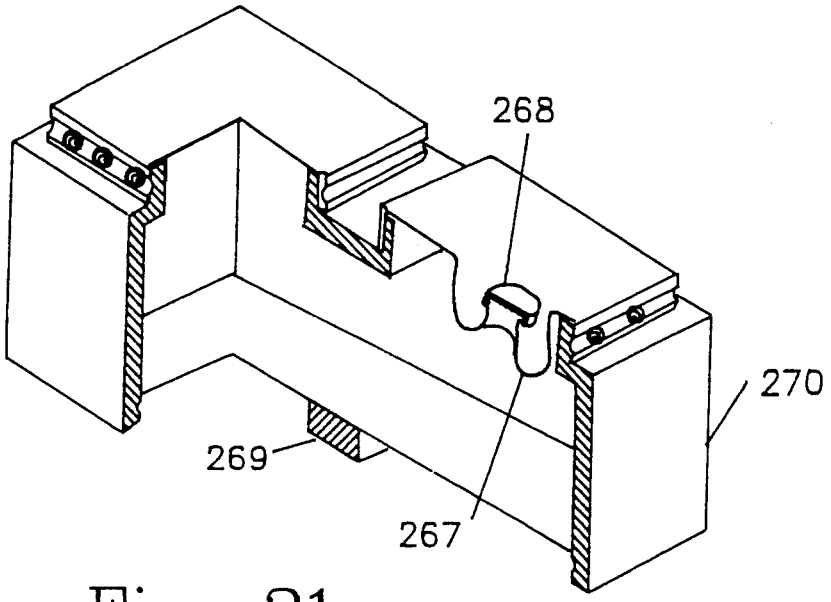
FIG. 21 is a cutaway view of a full block adapted for alternate use as a liquid container.

FIG. 21 is a full block embodiment similar to the half block version illustrated in FIG. 18 in that a flexible pouring spout 267 is provided in one top extension. The spout is sealed by a cap 268 to create a liquid container. With the exception of a pouring spout 267 in one of the top extensions, the top of this block is identical to the blocks illustrated in FIGS. 19 or 20 and they may or may not include full or partial locking extensions or grooves. A center reinforcing web is eliminated so that the full interior volume may be used for liquid storage but a reinforcing segment 269 is provided to add rigidity to the bottom and additional support. This web section is dimensioned to fill the space between adjacent blocks in a nested, overlapping assembly created from the blocks.

The liquid containing block illustrated in FIG. 21 also includes vertical corrugations which increase the rigidity of the container.

Figure 22:
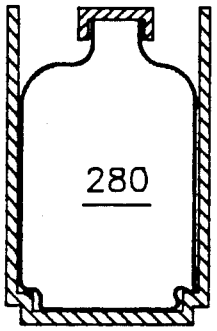
FIG. 22 is a cutaway view of a block incorporating a bottle-like container.

If the liquid to be contained within the blocks requires more security than would be provided by a rectangular walled configuration, a bottle such as 280 may be adhesively bonded to the interior of a block having a closed and opened end as illustrated in FIG. 22.

Figure 23:
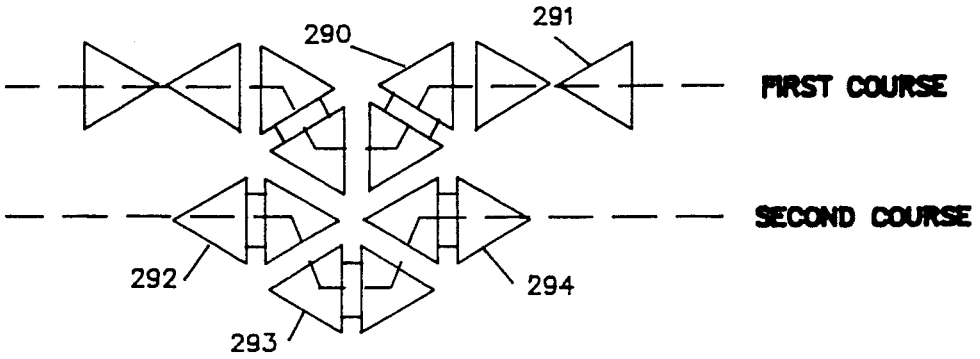
FIG. 23 illustrates a section of wall fabricated from blocks incorporating a triangular geometry.

The configurations illustrated in FIGS. 15 through 22 may be provided in practically any geometrical shape desired as previously suggested for the other alternate embodiments. For instance, FIG. 23 illustrates a portion of a wall formed from blocks using triangular configurations for the block halves. The triangular halves may be joined along the base as illustrated by blocks 290 or at the apexes as illustrated by blocks 291. The two varieties may be intermixed to create a multi-segment wall of interlocking design both vertically and horizontally as illustrated in FIG. 23. FIG. 23 is an exploded top plan view of two courses of a multi-segment wall. This type of structure may be rotated 90 degrees to create a further version where the figure becomes a plane view of the side of the wall illustrating first and second courses with one course comprised of the three elements 292, 293 and 294.

Figure 24:
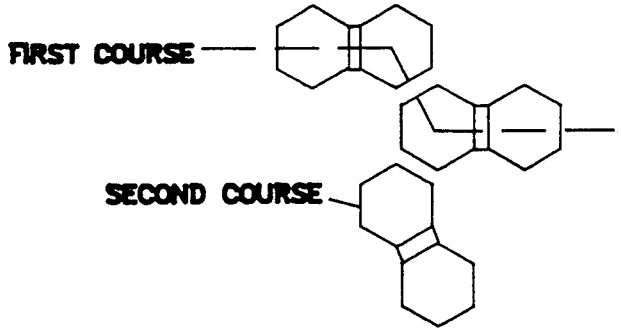
FIG. 24 illustrates a section of wall fabricated from blocks incorporating a hexagon geometry.
Figure 25:
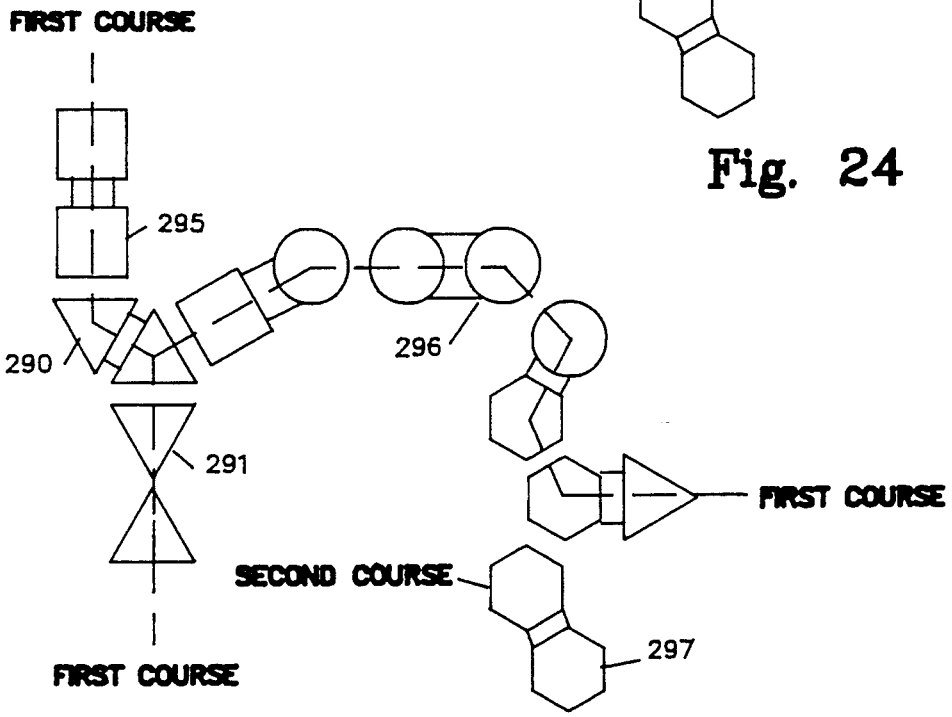
FIG. 25 illustrates a section of wall fabricated from blocks incorporating a plurality of geometries.

In FIGS. 23, 24 and 25, two block courses are illustrated. The first course comprises those blocks joined by a dashed line and annotated "FIRST COURSE". The second course is annotated "SECOND COURSE" and dashed lines are not provided in FIGS. 24 and 25. To visualize how the wall is assembled, move the second course block or blocks towards the top of the Figure to superimpose it over the blocks in the first course.

FIG. 24 illustrates a group of blocks having hexagon geometries for each block half. Configurations such as this afford a variety of unique, interlocking arrangements as illustrated in FIG. 24.

FIG. 27 illustrates a wall segment comprised of a plurality of different styles of block modules. The traditional rectangular modules such as 295 may be combined with triangular modules 290 which may in turn be combined with triangular modules of the alternate variety, 291. Circular modules 296 and hexagon modules 297 may be included in the combination also. If this type of structure is desired, special transition blocks must be used. For instance, block 295 must be joined to block 290 by a block comprised of a square and a triangular half but block 290 may be joined to block 291 by a block of the 290 style while two 290 blocks must be joined by a 291 block.

The circular blocks 296 find utility in allowing great latitude in changing the angle of a wall or forming the wall into any desired geometric shape. For instance, as illustrated in FIG. 25, if dual circular blocks such as 296 are used, alternate courses of half breed blocks having a circular segment and a triangular segment may be used to create a bend in a wall formed from triangular blocks and half breed blocks having hexagon and circular segments may be used to form a wall having hexagon block sections.

The variety of combinations suggested for FIG. 25 are presented as a suggestion only and it is anticipated that the variety and form of the blocks used in such structures is unlimited within the scope of this patent and subject to any whim of the designer.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A construction block, comprising:

first and second identical wire frames, each forming a closed shape comprised of a first geometric shape joined to a second geometric shape formed as a mirror image of said first geometric shape;

said closed shape including a plurality of bends forming angles;

a plurality of braces for connecting said first and second wire frames together in a superposed, spaced apart orientation;

each of said braces comprising first and second sides joined along a common edge forming an angle equal to an angle of a bend in said closed shape;

each of said braces including latching means for securing one end of said brace to the wire frame of an adjacent block; and said braces are secured to said first and second frames on the inside of said frames within a bend having an angle corresponding to the angle of said brace with the hypotenuse of said brace angle facing the interior of said closed shape.

2. A construction block as defined in claim 1 wherein said angels are right angles.

3. A construction block, comprising:

a plurality of walls interconnected to form a hollow structural member including a top and a bottom contiguous block joining structure;

said top contiguous block joining structure comprising a first closed geometric shape adjacent to a second closed geometric shape formed as a mirror image of said first geometric shape;

said first and second closed geometric shapes comprising a structure protruding above said walls and having a width less than the width of said hollow structural member and a combined length less than the length of said hollow structural member; and said bottom contiguous block joining structure comprising a recess within said hollow structural member dimensioned to receive a joining structure dimensioned identically to said top contiguous block joining structure.

4. A construction block as defined in claim 3 wherein said walls on one side of said construction block are equal in length but not of the same length as said walls on the other side of said construction block.

5. A construction block as defined in claim 3 wherein said top contiguous block joining structure includes a channel in all of the outer surfaces of said first and second geometric shapes except contiguous surfaces and said bottom contiguous block joining structure includes coupling means about it's inner periphery dimensioned to mate with a joining structure dimensioned identically to said top contiguous block joining structure and including a channel about the outer periphery of it's first and second geometric shapes dimensioned identically to those of said top contiguous block joining structure.

6. A construction block as defined in claim 3 wherein said top contiguous block joining structure includes channels in outer surfaces of said first and second geometric shapes and said bottom contiguous block joining structure includes coupling means about it's inner periphery dimensioned to mate with a joining structure dimensioned identically to said top contiguous block joining structure and including channels in outer surfaces of it's first and second geometric shapes dimensioned identically to those of said top contiguous block joining structure.

7. A construction block as defined in claim 6 wherein said bottom contiguous block joining structure coupling means comprises a plurality of balls dimensioned to fit partially within said top contiguous block joining structure channels.

8. A construction block as defined in claim 7 wherein said bottom contiguous block joining structure coupling means comprises channel means dimensioned to encompass a portion of each of said balls.

9. A construction block as defined in claim 6 wherein said bottom contiguous block joining structure coupling means comprises a projecting ridge.

10. A construction block as defined in claim 6 wherein the top of said block is a closed structure.

11. A construction block as defined in claim 6 wherein the bottom of said block is a closed structure.

12. A construction block as defined in claim 6 wherein the top of said block is a closed structure including a spout and spout closure.

13. A construction block as defined in claim 3 wherein said top contiguous block joining structure includes a coupling means in outer peripheral surfaces of said first and second geometric shapes and said bottom contiguous block joining structure includes channel means about it's inner periphery dimensioned to mate with a coupling means dimensioned identically to said top contiguous block joining structure coupling means.

14. A construction block as defined in claim 13 wherein said top contiguous block joining structure coupling means comprises a plurality of balls dimensioned to fit partially within said bottom contiguous block joining structure channel means.

15. A construction block as defined in claim 14 wherein said top contiguous block joining structure coupling means comprises channel means dimensioned to encompass a portion of each of said balls.

16. A construction block as defined in claim 13 wherein said top contiguous block joining structure coupling means comprises a projecting ridge.

17. A construction block as defined in claim 13 wherein said first closed geometric shape is rectangular.

18. A construction block as defined in claim 13 wherein said first closed geometric shape is triangular.

19. A construction block as defined in claim 13 wherein said first closed geometric shape is hexagonal.

20. A construction block as defined in claim 13 wherein said first closed geometric shape is circular.

21. A construction block as defined in claim 13 wherein the top of said block is a closed structure.

22. A construction block as defined in claim 13 wherein the bottom of said block is a closed structure.

23. A construction block as defined in claim 22 wherein the top of said block is a closed structure including a spout and spout closure.

24. A construction block, comprising:

a plurality of walls interconnected to form a hollow structural member including a top and a bottom contiguous block joining structure;

said top contiguous block joining structure comprising a first closed geometric shape adjacent to a second closed geometric shape;

said first and second closed geometric shapes comprising a structure protruding above said walls and having a width less than the width of said hollow structural member and a combined length less than the length of said hollow structural member; and said bottom contiguous block joining structure comprising a recess within said hollow structural member dimensioned to receive a joining structure dimensioned identically to said top contiguous block joining structure.

25. A construction block as defined in claim 24 wherein said walls on one side of said construction block are equal in length but not of the same length as said walls on the other side of said construction block.

26. A construction block as defined in claim 24 wherein said top contiguous block joining structure includes a channel in all of the outer surfaces of said first and second geometric shapes except contiguous surfaces. and said bottom contiguous block joining structure includes coupling means about it's inner periphery dimensioned to mate with a joining structure dimensioned identically to said top contiguous block joining structure and including a channel about the outer periphery of it's first and second geometric shapes dimensioned identically to those of said top contiguous block joining structure.

27. A construction block as defined in claim 24 wherein said top contiguous block joining structure includes channels in outer surfaces of said first and second geometric shapes and said bottom contiguous block joining structure includes coupling means about it's inner periphery dimensioned to mate with a joining structure dimensioned identically to said top contiguous block joining structure and including channels in outer surfaces of it's first and second geometric shapes dimensioned identically to those of said top contiguous block joining structure.

28. A construction block as defined in claim 27 wherein said bottom contiguous block joining structure coupling means comprises a plurality of balls dimensioned to fit partially within said top contiguous block joining structure channels.

29. A construction block as defined in claim 28 wherein said bottom contiguous block joining structure coupling means comprises channel means dimensioned to encompass a portion of each of said balls.

30. A construction block as defined in claim 27 wherein said bottom contiguous block joining structure coupling means comprises a projecting ridge.

31. A construction block as defined in claim 24 wherein said first closed geometric shape is rectangular.

32. A construction block as defined in claim 24 wherein said first closed geometric shape is triangular.

33. A construction block as defined in claim 24 wherein said first closed geometric shape is hexagonal.

34. A construction block as defined in claim 24 wherein said first closed geometric shape is circular.

35. A construction block as defined in claim 24 wherein the top of said block is a closed structure.

36. A construction block as defined in claim 24 wherein the bottom of said block is a closed structure.

37. A construction block as defined in claim 36 wherein the top of said block is a closed structure including a spout and spout closure.

38. A construction block as defined in claim 24 wherein said top contiguous block joining structure includes a coupling means in outer peripheral surfaces of said first and second geometric shapes and said bottom contiguous block joining structure includes channel means about it's inner periphery dimensioned to mate with a coupling means dimensioned identically to said top contiguous block joining structure coupling means.

39. A construction block as defined in claim 38 wherein said top contiguous block joining structure coupling means comprises a plurality of balls dimensioned to fit partially within said bottom contiguous block joining structure channel means.

40. A construction block as defined in claim 38 wherein said top contiguous block joining structure coupling means comprises channel means dimensioned to encompass a portion of each of said balls.

41. A construction block as define said top contiguous block joining structure coupling means comprises a projecting ridge.

42. A construction block as defined in claim 38 wherein said first closed geometric shape is rectangular.

43. A construction block as defined in claim 38 wherein said first closed geometric shape is triangular.

44. A construction block as defined in claim 38 wherein said first closed geometric shape is hexagonal.

45. A construction block as defined in claim 38 wherein said first closed geometric shape is circular.

46. A construction block as defined in claim 38 wherein the top of said block is a closed structure.

47. A construction block as defined in claim 38 wherein the bottom of said block is a closed structure.

48. A construction block as defined in claim 47 wherein the top of said block is a closed structure including a spout and spout closure.

* * * * *